United States Patent [19]

Oberdorf

[11] Patent Number: 4,564,412

[45] Date of Patent: Jan. 14, 1986

[54] METHOD OF AND APPARATUS FOR APPLYING SEAL STAMPS

[75] Inventor: Manfred Oberdorf, Gevelsberg, Fed. Rep. of Germany

[73] Assignee: Maschinenfabrik Alfred Schmermund GmbH & Co., Gevelsberg, Fed. Rep. of Germany

[21] Appl. No.: 665,361

[22] Filed: Oct. 26, 1984

[30] Foreign Application Priority Data

Nov. 2, 1983 [DE] Fed. Rep. of Germany ..... 3339555

[51] Int. Cl.[4] ..... B65C 1/06; B65C 9/10; B65C 9/22

[52] U.S. Cl. ..... 156/484; 156/497; 156/568; 156/571; 156/578; 156/DIG. 4; 156/DIG. 29; 156/DIG. 35

[58] Field of Search ..... 156/484, 485, 497, 568, 156/571, 572, 578, DIG. 4, DIG. 29, DIG. 31, DIG. 35

[56] References Cited

U.S. PATENT DOCUMENTS 1,817,831 8/1931 Molins et al. ..... 156/DIG. 4
3,989,583 11/1976 Watson ..... 156/568
4,210,481 7/1980 Wolff et al. ..... 156/571

FOREIGN PATENT DOCUMENTS 531304 1/1941 United Kingdom ..... 156/484

*Primary Examiner*—Michael Wityshyn

[57] ABSTRACT

Stamps, labels and the like are affixed to moving packages, for example cigarette packages, by a process which includes the withdrawal of individual stamps or labels from a magazine, the application of an adhesive to spaced points along laterally separated linear regions thereof and the transfer of the stamps or labels with the adhesive applied thereto to a fork-like mechanism which conveys the stamps or labels into registration with the path of movement of the articles to which they are to be affixed, the articles contacting the side of the stamps or labels having the adhesive thereon and passing between the tines of the fork-like mechanism. Adhesive is applied to the stamps or labels by a roller defined by a plurality of spacially separated discs, some of the discs functioning as vacum-assisted holders for the stamps and the other discs having surface depressions for receiving the adhesive which is subsequently transferred to the stamps or labels.

20 Claims, 2 Drawing Figures

METHOD OF AND APPARATUS FOR APPLYING SEAL STAMPS

BACKGROUND OF THE INVENTION

1. Field of the Invention

The present invention relates to the affixation of stamps, labels and the like to articles and particularly to the attachment of adhesively coated seal stamps to packages of cuboid shape. More specifically, this invention is directed to apparatus for the extraction of stamps or labels from a magazine, the application of an adhesive thereto and the subsequent placement of the adhesive coated stamps or labels to moving packages and especially to apparatus for the attachment of seal stamps to cigarette packages. Accordingly, the general objects of the present invention are to provide novel and improved methods and apparatus of such character.

2. Description of the Prior Art

While not limited thereto in its utility, the present invention is particularly well-suited for attaching seal stamps to cigarette packages. Devices for attaching seal stamps to cigarette or other similar packages are known in the art. For example, published German Patent Application No. 3,309,064 shows apparatus in which seal stamps are extracted from a magazine by means of an oscillating transfer arm which delivers the stamps onto projections of a rotating drum. The stamps are held on the rotating drum by suction and, as the drum rotates, are coated with glue by means of glue-receiving projections on a cooperating glue roller. Subsequent to the application of glue to the stamps, they are passed on to a transfer roller which, in turn, delivers the coated stamps to a turret. The stamps are held in the turret by means of suction and cigarette packages are pushed out of the turret toward the stamps whereby the stamps will wrap around the end faces of the packages which are pushed thereagainst. The apparatus of German Application No. 3,309,064 is quite complex in its construction and thus is expensive to manufacture and maintain.

Another example of prior art apparatus for the attachment of seal stamps to cigarette packages may be seen from published European application No. 0,034,790. In the apparatus of this European application a rotating glue segment is coated with glue by a roller and, in turn, transfers the glue onto first sides of the seal stamps as the stamps are moved by a gripper cylinder. The glue-coated seal stamps are then applied, by the gripper cylinder, to the end faces of cigarette packages which are supported in cells of a turret. The cigarette packages are subsequently pushed out of the turret into a transfer slot or tube whereupon the protruding ends of the stamps will be folded over against the sides of the packages. As is the case with the apparatus of the above-discussed German Application No. 3,309,064, the apparatus of European application No. 0,034,790 is characterized by a relatively high degree of technical complexity and thus is expensive to manufacture and use.

Another example of a prior art seal stamp applying apparatus may be seen from Federal Republic of Germany Pat. No. 1,266,210. In the apparatus of this patent a single drum is employed to extract the stamps from a magazine and apply the stamps to the packages. This drum interacts with a glue roller so that an adhesive will be applied to the backs of the stamps subsequent to their extraction from a magazine but prior to application to the packages. The drum of the apparatus of German Pat. No. 1,266,210 is characterized by a plurality of raised annular surface portions which are provided with suction ports. A "stripping-off" band is provided in the annular spaces between these annular projections and the glue roller is provided with raised portions which are complementary to these annular spaces. Accordingly, the adhesive is applied to the stamps only in the regions which are in registration with the annular spaces. This arrangement insures that the suction orifices will not be clogged with glue should there be a failure to transfer a stamp to the roller. However, the arrangement of German Pat. No. 1,266,210 has the significant disadvantage that the seal stamps are not supported in the regions where the glue is applied thereto and thus the stamps are subject to distortion and may not be properly applied to the package. Here again the apparatus is comparatively complex, and thus expensive. Further, a supplemental mechanism must be employed with the appratus of German Pat. No. 1,266,210 in order to fold the adhesively coated sealing stamps around and into contact with the sides of the packages.

The prior art is also exemplified by bottle-labeling machines such as that shown in German Pat. No. 2,826,618. Such bottle labeling machines employ glue segments, i.e., rotatable members which are in the form of a segment of a cylinder, which are both rotatable about an axis and displacable in a radial direction by means of cams. These glue segments are coated with glue via a glue roller and, when coated with the glue, directly extract the labels from a magazine and transfer glue thereto. The glue-coated labels are then transferred to a gripper cylinder which applies the labels to the bottles. Such bottle-labeling machines are also characterized by mechanical complexity, and thus comparatively high expense, and in any event are not suitable for the attachment of seal stamps to cigarette packages and the like.

SUMMARY OF THE INVENTION

The present invention overcomes the above-discussed and other deficiencies and disadvantages of the prior art by providing a novel and improved technique for the attachment of seal stamps, labels and the like to moving packages, particularly packages of cuboid shape. Apparatus in accordance with the present invention is characterized by an uncomplicated construction which renders it highly reliable and comparatively inexpensive to manufacture. This apparatus includes a magazine which receives and temporarily stores the seal stamps or labels, an extraction device for extracting individual stamps or labels from the magazine, a glue roller for applying an adhesive to the backs of the extracted stamps or labels and a transfer device for transferring the adhesive coated stamps or labels onto moving packages.

In accordance with a preferred embodiment of the invention, the glue roller is divided into a plurality of spaced annular, i.e., disc-shaped, portions. Some of these annular portions of the glue roller are provided with suction ports which are connected to a low pressure source to thereby capture the stamps or labels. Accordingly, stamps which have been extracted from the magazine are held on the glue roller by suction during the application of glue to the back sides thereof. The remaining annular portions of the glue roller are provided with surface depressions which receive preselected quantities of the adhesive before the stamp or label is delivered to the roller. The adhesive receiving portions of the glue roller cooperate with complementary slots in an adhesive dispenser and this cooperation insures against the contacting of other parts of the glue roller with adhesive.

The transfer device in accordance with the preferred embodiment comprises a generally fork-shaped pivotal member which is provided, in the tines of the fork, with further suction ports. The transfer device is shaped, at least in the region of the tines which are provided with the suction ports, so as to establish a tangential relationship with the periphery of the glue roller during the pivoting of the fork-shaped member. Accordingly, synchronized movement of the transfer device and the glue roller will result in the tines of the moving transfer device contacting the moving label or stamp along a line whereupon the label or stamp which has received adhesive from the surface depressions on the glue roller will be passed from the glue roller to the transfer device. The transfer device then continues the movement of the stamp or label to a position where it is in alignment with a moving package which will pass between the tines of the transfer device. The stamp or label will thus be applied to the end of the package and be folded over and into contact with the sides thereof.

BRIEF DESCRIPTION OF THE DRAWING

The present invention may be better understood and its numerous objects and advantages will become apparent to those skilled in the art by reference to the accompanying drawing wherein like reference numerals refer to like elements in the two FIGURES and in which.

DESCRIPTION OF THE DISCLOSED EMBODIMENT

Figure 1:
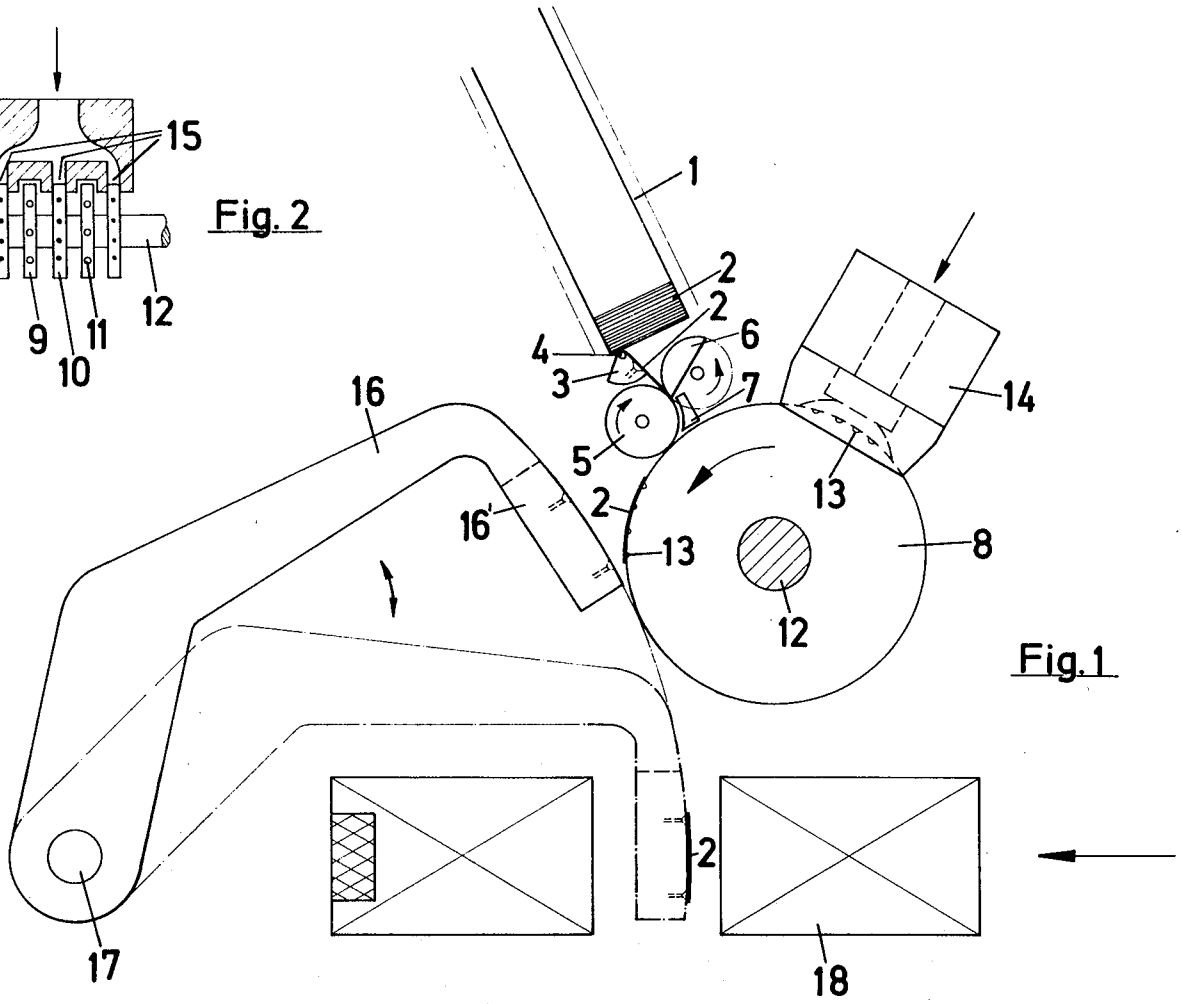
FIG. 1 is a schematic side-elevation view of apparatus in accordance with a preferred embodiment of the present invention.

With reference now to the drawing, a magazine 1 is loaded with a stack of seal stamps or labels 2 which are to be applied to packages 18. The stamps 2 are individually extracted from the bottom of magazine 1 by means of a "segment" 3. Segment 3 is a member in the form of a segment of a cylinder which is rotatable about its axis 4. Segment 3 is provided with suction ports, which are coupled to a suitable source of low pressure, not shown. The suction applied to the ports in segment 3 will be sufficient to pull a stamp from the bottom of the magazine and rotate it downwardly. A pressure roller 5 cooperates with a segmental roller 6 and a fixed guide element 7 to transfer the extracted stamp 2 from the segment 3 onto a glue roller 8. Thus, a seal stamp extracted from magazine 1 is pivoted in the direction of roller 5 by segment 3 and then is guided by means of the segmental roller 6 into the gap between rollers 5 and 6. The stamp is then conveyed in the direction of rotation of glue roller 8 by means of the guide element 7 and is pressed against the periphery of roller 8 by means of roller 5.

Figure 2:
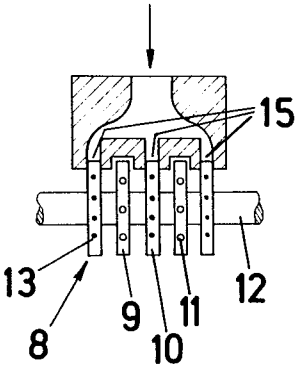
FIG. 2 is a front elevation view, partly in section, of the glue roller and adhesive dispenser of the apparatus of FIG. 1.

As may be seen from FIG. 2, the glue roller 8 is defined by a plurality of spacially separated discs 9 and 10 of the same diameter. The discs 9 are provided with suction ports in their end faces, these suction ports being connected to a low pressure source in any suitable manner. For example, the suction ports in discs 9 can be connected, via passages in the axle 12 of roller 8, to a vacuum pump. The discs 10 are provided, in their end faces, with surface depressions 13 which receive the adhesive to be transferred to the stamps 2. In the disclosed embodiment the discs 9 and 10 are alternated with the adhesive-receiving discs 10 being provided at least at the outer edges and in the center of roller 8. The suction ports 11 and the glue receiving depressions 13 are respectively provided in portions of roller 8 which correspond to the width of a seal stamp 2. For example, there may be four such portions which are spacially separated on the periphery of the roller 8.

During rotation, glue roller 8 passes an adhesive supply device 14 which is located upstream, in the direction of rotation of roller 8, from pressure roller 5. The adhesive supply device 14 is connected to a reservoir, not shown. Adhesive supply device 14, as may be seen from FIG. 2, is provided with adhesive delivery slots 15 into which the discs 10 penetrate and "blind" slots through which the edge regions of discs 9 pass. The rollers 10 and slots 15 are complementary shaped so that a sealing relationship is established. Accordingly, no adhesive can escape and coat regions on the roller, such as the suction ports 11, which must be maintained free of contamination. Rather, the arrangement is such that only the depressions 13 in the discs 10 will be filled with adhesive and convey the adhesive away from the supply device 14.

When a seal stamp 2 is pressed against the glue roller 8 by pressure roller 5, the seal stamp will be coated at a plurality of points, along plural lines, by the adhesive which was previously received by the depressions 13 in discs 10. The stamp will be captured by, and thus will rotate with, the glue roller 8 because of the action of the suction ports in discs 9.

When the glue roller 8 rotates further, the adhesive-coated seal stamp 2 will be transferred to a member 16 which is in the form of a lever having a fork-shaped free end 16'. The lever 16 is pivotal about an axle 17 alternately clockwise and counterclockwise. The fork-shaped free end portion 16' of lever 16 has a curved periphery for the reason to be described below. The tines of the fork-shaped portion 16' of lever 16 are provided with suction ports which are connected to a suitable low pressure source. The pressure applied to the stamps via the suction ports in lever 16 will be sufficient to withdraw the stamp from roller 8. If necessary, the connection of the suction ports in the fork-shaped portion 16' of lever 16 to the low pressure source may be synchronized with the disconnecting of the low pressure source from the suction ports 11 in the discs 9 of roller 8. The lever 16 is arranged such that, as it pivots out of the position shown in solid lines to that shown in broken lines, the curved outer surfaces of the tines of the fork-shaped portion 16' thereof will engage the periphery of glue roller 8, i.e., the curvature of portion 16' is selected such that it will be tangential to the outer periphery of roller 8. Thus, a moving "line" of contact will be established and a stamp 2 will be "peeled" off the glue roller by the member 16.

After the seal stamp 2 has been transferred to the fork-shaped end portion 16', it will be conveyed to the position represented by the broken line showing of lever 16 in FIG. 1 as a result of the continued clockwise rotation of the lever. The side of the stamp 2 which has had the adhesive transferred thereto will be facing outwardly with respect to lever 16. The space between the tines of the fork-shaped end portion 16' of lever 16 will be commensurate with the width of the package 18 too which the stamp 2 is to be affixed and, if necessary or desirable, the tines may define a slightly converging passage in the direction of movement of the package 18. The package 18, which in the disclosed embodiment is a cigarette package, is pushed, transversely to the angled end-portion 16' of lever 16, between the tines thereof with the result that the end face of the package 18 first engages the middle portion of the seal stamp 2 and then, as the cigarette package 18 is pushed between the tines, the ends of the seal stamp 2 are folded over and against the sides of the cigarette package. The arrangement of the present invention has the particular advantage that the cigarette packages 18 do not need to be received in a special turret for seal stamp application as has been the prior art practice. To the contrary, the packages can simply be moved along a conveyor track, for example by means of a ram.

While a preferred embodiment has been shown and described, various modifications and substitutions may be made thereto without departing from the spirit and scope of the invention. By way of example only, while the disclosed embodiment has been described as being used for the affixation of seal stamps to cigarette packages, it is applicable to the attachment of labels to other articles of essentially cuboid shape. Accordingly, the present invention has been described by way of illustration and not limitation.

What is claimed is:

1. Apparatus for the affixation of stamps to moving articles comprising:

magazine means for receiving and temporarily storing a plurality of stamps;

means for extracting stamps from said magazine;

means for applying an adhesive to a first side of the extracted stamps, said adhesive applying means including:

means defining a generally cylindrically shaped adhesive transfer roller, said roller defining means having a plurality of discrete coaxial surface portions, at least some of said portions being provided with suction ports in the radially outwardly facing surface thereof for connection to a low pressure source and the other of said surface portions being provided with depressions in the radially outwardly facing surface thereof for receiving quantities of adhesive; and adhesive supply means, said adhesive supply means including a plurality of adhesive delivery channels equal in number to and having a width complementary to said other portions of said roller defining means, an adhesive being supplied to said delivery channels, said adhesive supply means being positioned such that said other roller defining means portions cooperate with said channels during rotation of said transfer roller whereby adhesive will be delivered to said depressions in said roller defining means other portions, said adhesive supply means being located before said extraction means in the direction of rotation of said adhesive transfer roller defining means, said extraction device delivering the stamps to said transfer roller defining means whereby the stamps will be held by the low pressure applied to the suction ports of said some of said surface portions and adhesive will be transferred thereto from the depressions in the other of said surface portions; and means for conveying stamps from said adhesive applying means to articles which are moving along a path, said conveying means having a pair of spacially displaced arms, simultaneous movement of said arms causing portions thereof to be substantially tangential to said roller defining means surface portions at the points of closest approach therebetween, the stamps being attracted to said arms and being removed from said adhesive applying means transfer roller defining means, said removed stamps being conveyed into position in registration with said path whereby articles moving along said path will contact the side of the stamps having adhesive thereon as the articles pass between said arms.

2. The apparatus of claim 1 wherein said depressions in said other surface portions of said transfer roller defining means are punctiform.

3. The apparatus of claim 1 wherein said transfer roller defining means comprises a plurality of disc-shaped members, said disc-shaped members being spacially separated and including said surface portions.

4. The apparatus of claim 3 wherein said depressions in said other disc-shaped members of said transfer rollers are punctiform.

5. The apparatus of claim 1 wherein said some of said transfer roller defining means surface portions and said other of said transfer roller defining means surface portions are arranged alternately.

6. The apparatus of claim 5 wherein said transfer roller defining means comprises a plurality of disc-shaped members, said disc-shaped members being spacially separated and including said surface portions.

7. The apparatus of claim 6 wherein said depressions in said other disc-shaped members of said transfer roller defining means are punctiform.

8. The apparatus of claim 6 wherein said extracting means comprises:

means for attracting and withdrawing stamps from said magazine; and means for feeding the thus withdrawn stamps to the surface of said adhesive applying means transfer roller defining means, said feeding means including a pressure roller which urges the extracted stamps against the surface portions of said transfer roller defining means.

9. The apparatus of claim 6 wherein said conveying means comprises:

an elongated lever, said lever being mounted for pivotal movement about a first end thereof; and a fork-shaped element extending from the second end of said lever, said fork-shaped element including said spacially displaced arms, said arms having suction ports therein for connection to a low pressure source whereby said conveying means may remove stamps from said adhesive applying means transfer roller defining means and subsequently support such removed stamps for contact by moving articles to which the stamps are to be adhesively affixed.

10. The apparatus of claim 9 wherein said extracting means comprises:

means for attracting and withdrawing stamps from said magazine; and means for feeding the thus withdrawn stamps to the surface of said adhesive applying means transfer roller defining means, said feeding means including a pressure roller which urges the extracted stamps against the surface portions of said transfer roller defining means.

11. The apparatus of claim 1 wherein said other of said adhesive transfer roller defining means surface portions extend into said delivery channels of said adhesive supply means.

12. The apparatus of claim 11 wherein said transfer roller defining means comprises a plurality of disc-shaped members, said disc-shaped members being spacially separated and including said surface portions.

13. The apparatus of claim 12 wherein said disc-shaped members which are provided with suction ports and said disc-shaped members which are provided with adhesive receiving depressions are alternately arranged on said adhesive transfer roller defining means.

14. The apparatus of claim 13 wherein said conveying means comprises:

an elongated lever, said lever being mounted for pivotal movement about a first end thereof; and a fork-shaped element extending from the second end of said lever, said fork-shaped element including said spacially displaced arms, said arms having suction ports therein for connection to a low pressure source whereby said conveying means may remove stamps from said adhesive applying means transfer roller defining means and subsequently support such removed stamps for contact by moving articles to which the stamps are to be adhesively affixed.

15. The apparatus of claim 13 wherein said depressions in said other disc-shaped members of said transfer rollers are punctiform.

16. The apparatus of claim 15 wherein said conveying means comprises:

an elongated lever, said lever being mounted for pivotal movement about a first end thereof; and a fork-shaped element extending from the second end of said lever, said fork-shaped element including said spacially displaced arms, said arms having suction ports therein for connection to a low pressure source whereby said conveying means may remove stamps from said adhesive applying means transfer roller defining means and subsequently support such removed stamps for contact by moving articles to which the stamps are to be adhesively affixed.

17. The apparatus of claim 16 wherein said extracting means comprises:

means for attracting and withdrawing stamps from said magazine; and means for feeding the thus withdrawn stamps to the surface of said adhesive applying means transfer roller defining means, said feeding means including a pressure roller which urges the extracted stamps against the surface portions of said transfer roller defining means.

18. The apparatus of claim 1 wherein said conveying means comprises:

an elongated lever, said lever being mounted for pivotal movement about a first end thereof; and a fork-shaped element extending from the second end of said lever, said fork-shaped element including said spacially displaced arms, said arms having suction ports therein for connection to a low pressure source whereby said conveying means may remove stamps from said adhesive applying means transfer roller defining means and subsequently support such removed stamps for contact by moving articles to which the stamps are to be adhesively affixed.

19. The apparatus of claim 18 wherein said extracting means comprises:

means for attracting and withdrawing stamps from said magazine; and means for feeding the thus withdrawn stamps to the surface of said adhesive applying means transfer roller defining means, said feeding means including a pressure roller which urges the extracted stamps against the surface portions of said transfer roller defining means.

20. The apparatus of claim 1 wherein said extracting means comprises:

means for attracting and withdrawing stamps from said magazine; and means for feeding the thus withdrawn stamps to the surface of said adhesive applying means transfer roller defining means, said feeding means including a pressure roller which urges the extracted stamps against the surface portions of said transfer roller defining means.

* * * * *